US010731640B2

(12) United States Patent
Teshima et al.

(10) Patent No.: US 10,731,640 B2
(45) Date of Patent: Aug. 4, 2020

(54) RECIPROCATING PUMP

(71) Applicant: NIPPON PILLAR PACKING CO., LTD., Osaka-shi (JP)

(72) Inventors: Kazukiyo Teshima, Osaka (JP); Daisuke Urata, Osaka (JP); Naoto Yamada, Osaka (JP); Takuya Murakami, Osaka (JP)

(73) Assignee: NIPPON PILLAR PACKING CO., LTD., Osaka-shi (JP)

( * ) Notice: Subject to any disclaimer, the term of this patent is extended or adjusted under 35 U.S.C. 154(b) by 0 days.

(21) Appl. No.: 16/322,587

(22) PCT Filed: Jun. 15, 2017

(86) PCT No.: PCT/JP2017/022140
§ 371 (c)(1),
(2) Date: Feb. 1, 2019

(87) PCT Pub. No.: WO2018/025520
PCT Pub. Date: Feb. 8, 2018

(65) Prior Publication Data

US 2019/0178241 A1 Jun. 13, 2019

(30) Foreign Application Priority Data

Aug. 3, 2016 (JP) ..... 2016-152586

(51) Int. Cl.
*F04B 43/02* (2006.01)
*F04B 43/08* (2006.01)
(Continued)

(52) U.S. Cl.
CPC ..... *F04B 43/02* (2013.01); *F04B 43/04* (2013.01); *F04B 43/08* (2013.01); *F04B 43/09* (2013.01);
(Continued)

(58) Field of Classification Search
None
See application file for complete search history.

(56) References Cited

U.S. PATENT DOCUMENTS 4,836,756 A * 6/1989 Fukumoto ..... F04B 43/0063 417/394
5,647,733 A * 7/1997 Augustyn ..... F04B 43/009 417/360
(Continued)

FOREIGN PATENT DOCUMENTS

JP 62-85185 A 4/1987
JP 2-13184 U 1/1990
(Continued)

OTHER PUBLICATIONS

International Search Report dated Sep. 5, 2017 in PCT/JP2017/022140 filed Jun. 15, 2017.

*Primary Examiner* — F Daniel Lopez
*Assistant Examiner* — Michael Quandt
(74) *Attorney, Agent, or Firm* — Oblon, McClelland, Maier & Neustadt, L.L.P.

(57) ABSTRACT

A reciprocating pump includes: a housing with a suction port and a discharge port; a reciprocated member disposed in the housing to form a pump chamber and reciprocable such that fluid is sucked into the pump chamber through the suction port and then discharged from the pump chamber through the discharge port; an actuator configured to reciprocate the reciprocated member; and a pressure gauge with a pressure receiving portion, configured to detect pressure of the fluid in the pump chamber through the pressure receiving portion, and coupled to the reciprocated member to be reciprocated by the actuator integrally with the reciprocated member.

3 Claims, 8 Drawing Sheets

(51) Int. Cl.

| | |
|---|---|
| ***F04B 49/06*** | (2006.01) |
| ***F04B 49/08*** | (2006.01) |
| ***F04B 43/09*** | (2006.01) |
| ***F04B 43/04*** | (2006.01) |

(52) U.S. Cl.
CPC ..... *F04B 49/06* (2013.01); *F04B 49/08* (2013.01); *F04B 2205/03* (2013.01); *F04B 2207/042* (2013.01); *F05B 2210/11* (2013.01); *F05B 2270/301* (2013.01)

(56) References Cited

U.S. PATENT DOCUMENTS

| | | | | |
|---|---|---|---|---|
| 6,094,970 | A * | 8/2000 | Sprenger | F04B 43/009 417/63 |
| 7,842,003 | B2 * | 11/2010 | Jones | F04B 49/065 417/477.1 |
| 2011/0182781 | A1 | 7/2011 | Dzuong | |

FOREIGN PATENT DOCUMENTS

| | | | |
|---|---|---|---|
| JP | 10-196523 | A | 7/1998 |
| JP | 2007-23935 | A | 2/2007 |
| JP | 2011-149937 | A | 8/2011 |
| JP | 2016-35242 | A | 3/2016 |
| JP | 2016-61169 | A | 4/2016 |

* cited by examiner

PRIOR ART

RECIPROCATING PUMP

TECHNICAL FIELD

The present invention relates to reciprocating pumps.

BACKGROUND ART

A kind of reciprocating pumps are known, which are for transferring fluids including liquids such as chemical solutions. The reciprocating pumps include, for example, diaphragm pumps as described in Patent Document 1. Such diaphragm pumps are frequently used for manufacturing semiconductor, liquid crystal, and organic electroluminescence (EL) devices, solar cells, and light emitting diodes (LED).

Such a reciprocating pump includes a housing, a reciprocated member, an actuator, and a pressure gauge. The housing has a suction port and a discharge port. The reciprocated member, which consists of a rolling diaphragm or the like, is disposed to form a pump chamber in the housing.

The reciprocated member is reciprocable in the housing such that fluid is sucked into the pump chamber through the suction port, and then discharged from the pump chamber through the discharge port.

The actuator reciprocates a movable member. The pressure gauge has a pressure receiving portion and through it, detects the pressure of fluid in the pump chamber. The pressure gauge is attached to the housing.

PRIOR ART DOCUMENT

Patent Document

Patent Document 1: Japanese Unexamined Patent Application Publication No. 2007-023935 A

SUMMARY OF THE INVENTION

As shown in FIG. 8, a conventional reciprocating pump uses a pressure gauge 206, which is a type screwed to a main body. A mounting hole 233 for the pressure gauge 206, which communicates with a pump chamber 228, is provided in a wall 211 of a housing 202. The pressure gauge 206 is screwed to the mounting hole 233 to be mounted on the wall 211 of the housing 202.

A pressure receiving portion 246 of the pressure gauge 206 is then placed around the pump chamber 228 to face the pump chamber 228. Space 238 between the pressure receiving portion 246 and the pump chamber 228 exists, which is caused by a step in the mounting hole 233, residual threads, or the like. When fluid fills the pump chamber 228, a liquid pool forms in the space 238 or the mounting hole 233, which communicates with the pump chamber 228.

When the liquid pool forms, particles tend to appear in the liquid pool. The particles may be mixed in the fluid filling the pump chamber 228, thereby lowering the purity of fluid discharged by the reciprocating pump from the pump chamber 228 through a discharge port.

The present invention has been made in view of such circumstances. An object of the present invention is to provide a reciprocating pump capable of preventing a liquid pool from forming in a pump chamber due to structure allowing a pressure gauge to be mounted thereon.

A reciprocating pump for transferring fluid according to one aspect of the present invention includes: a housing with a suction port and a discharge port; a reciprocated member disposed in the housing to form the pump chamber, and reciprocable such that fluid is sucked into the pump chamber through the suction port and then discharged from the pump chamber through the discharge port; an actuator configured to reciprocate the reciprocated member; and a pressure gauge with a pressure receiving portion, configured to detect pressure of fluid in the pump chamber via the pressure receiving portion, and coupled to the reciprocated member to be reciprocated by the actuator integrally with the reciprocated member.

This configuration prevents space, which causes a liquid pool when fluid fills the pump chamber, from forming in the pump chamber due to structure allowing the pressure gauge to be mounted to the housing. This results in no liquid pool in the pump chamber. Therefore, the reciprocating pump can be used to transfer fluid, while maintaining the fluid at excellent purity.

According to another aspect of the present invention, the reciprocated member has flexibility and includes a membranous portion between the pressure receiving portion and the pump chamber; the pressure gauge is disposed between the membranous portion and the actuator under the condition that the pressure receiving portion contacts the membranous portion.

According to still another aspect of the present invention, the reciprocated member includes a rolling diaphragm.

According to a further aspect of the present invention, the reciprocated member includes a bellows.

The present invention can provide a reciprocating pump capable of preventing a liquid pool from forming in a pump chamber due to structure allowing a pressure gauge to be mounted thereon.

DESCRIPTION OF THE EMBODIMENTS

A first embodiment of the present invention will be described with reference to the drawings.

Figure 1:
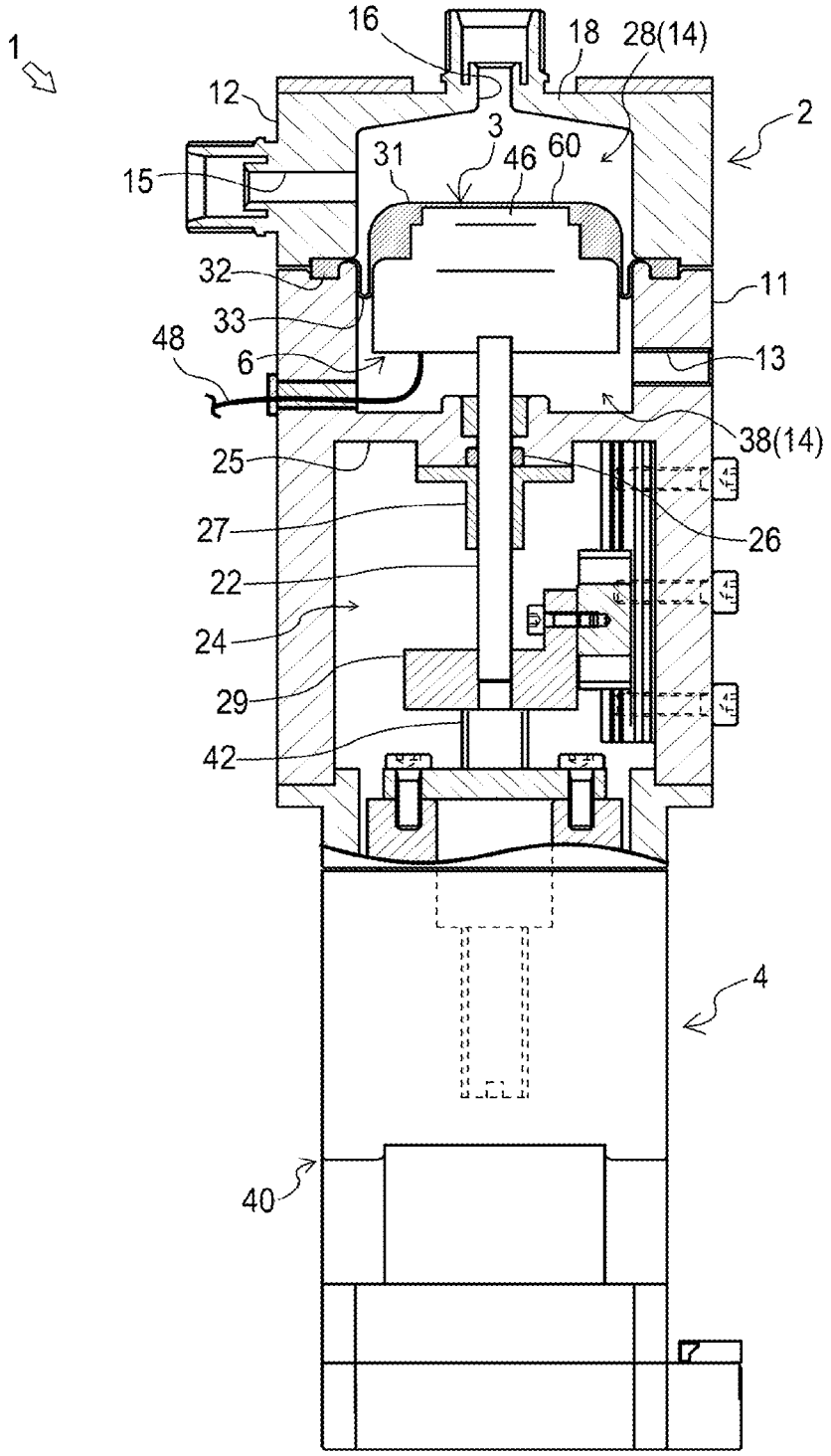
FIG. 1 is a side sectional view of a reciprocating pump according to a first embodiment of the present invention, showing the reciprocating pump after completion of a discharge.
Figure 2:
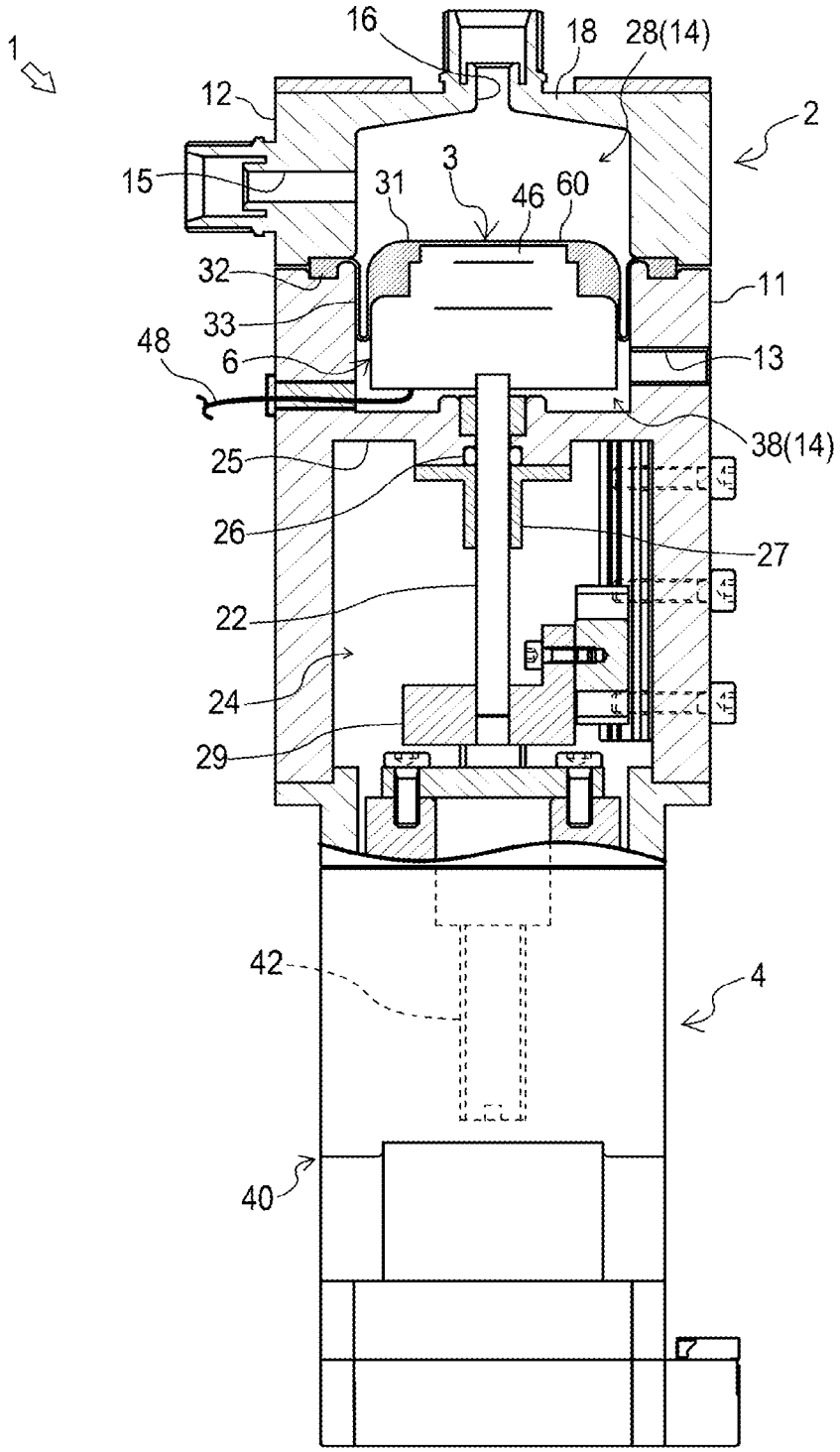
FIG. 2 is a side sectional view showing the reciprocating pump of FIG. 1 after completion of a suction.
Figure 3:
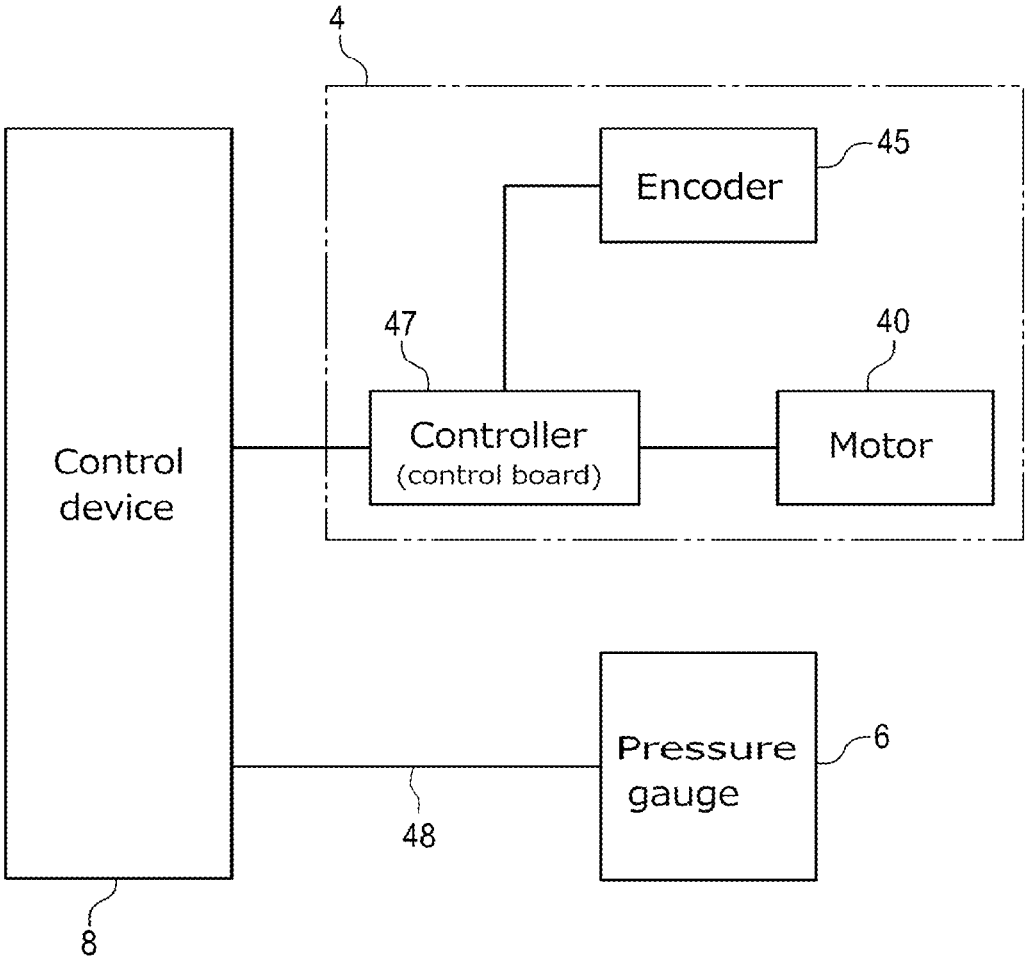
FIG. 3 is a schematic block diagram of the reciprocating pump in FIG. 1.

A reciprocating pump according to the first embodiment of the present invention is a diaphragm pump 1 for transferring fluid including liquids such as chemical solutions. As shown in FIGS. 1 and 2, the diaphragm pump 1 includes a housing 2, a reciprocated member (rolling diaphragm) 3, an actuator 4, and a pressure gauge 6. As shown in FIG. 3, the diaphragm pump 1 further includes a control device 8.

In the following description, a back-and-forth direction means a vertical direction on the drawings, advancement means forward movement, and retreat means backward movement.

The housing 2 has a suction port 15 and a discharge port 16. In the present embodiment, the housing 2 includes a cylinder 11 and a pump head 12. The cylinder 11 is made of stainless steel such as SUS 304. The cylinder 11 has a circular cylindrical shape and is disposed so that its axial direction is the back-and-forth direction.

The cylinder 11 has a vent hole 13. The vent hole 13 is provided in a side portion of the cylinder 11, extending therethrough in a direction crossing the axial direction of the cylinder 11 (that is, the axial direction of the housing 2). The vent hole 13 can be connected to a decompression device (not shown) such as a vacuum pump or an aspirator.

The pump head 12 is made of resin. For example, the pump head 12 is made of fluororesin such as polytetrafluoroethylene (PTFE). The pump head 12 has a covered, circular cylindrical shape with an inner diameter substantially the same as that of the cylinder 11. The pump head 12 is disposed coaxially with the cylinder 11.

The pump head 12 is attached to a first axial end (a front end) of the cylinder 11 to close an opening on the first axial side (the front side) of the cylinder 11. Thus, a first interior space 14 is formed to be surrounded by the cylinder 11 and the pump head 12 in the housing 2.

The pump head 12 has the suction port 15 and the discharge port 16. The suction port 15 is placed in a side portion of the pump head 12 to penetrate in a direction intersecting with the axial direction of the pump head 12. The suction port 15 is connected to a device (not shown) predetermined as a fluid source via a suction-side valve, piping, and others.

The discharge port 16 is placed in a first axial end (a front end) of the pump head 12, that is, a lid 18 to penetrate in the axial direction of the pump head 12. The discharge port 16 is radially placed in the central portion of the lid 18 and is connected to a device (not shown) predetermined as a fluid destination via a discharge-side valve, piping, and others.

The actuator 4 is configured to reciprocate the rolling diaphragm 3. For example, the actuator 4 has a shaft 22. The shaft 22 is reciprocable in the housing 2 (i.e. in the cylinder 11) and is connected to the rolling diaphragm 3 via the pressure gauge 6.

The shaft 22 is made of, for example, steel such as quenched high-carbon chromium bearing steel. The shaft 22 is disposed coaxially with the housing 2. The shaft 22 extends through a partition 25 of the housing 2 and an O-ring 26 so that the shaft 22 can be reciprocated in the axial direction of the housing 2. The partition 25 divides the interior space of the housing 2 into the first interior space 14 and a second interior space 24.

The O-ring 26 is held by an O-ring retainer 27 in the partition 25. The O-ring retainer 27 is made of, for example, stainless steel. The O-ring retainer 27 is disposed in the second interior space 24 of the housing 2 with the shaft 22 extending therethrough without contact with the O-ring retainer 27.

The shaft 22 has a first axial end (a front end) in the first interior space 14 and a second axial end (a back end) in the second interior space 24. The shaft 22 is connected to the pressure gauge 6 at the first axial end so that the shaft 22 can be reciprocated integrally with the pressure gauge 6 and the rolling diaphragm 3.

The actuator 4 has a shaft holder 29 to hold the shaft 22 in the housing 2. The shaft holder 29 is made of, for example, stainless steel. The shaft holder 29 is disposed in the second interior space 24 of the housing 2. The shaft holder 29 connects the shaft 22 with an output shaft 42 described later.

The rolling diaphragm 3 is disposed to form the pump chamber 28 in the housing 2. The rolling diaphragm 3 is reciprocable in the housing 2 to suck fluid into the pump chamber 28 through the suction port 15 and discharge fluid from the pump chamber 28 through the discharge port 16.

The rolling diaphragm 3 is made of resin, for example, fluororesin such as polytetrafluoroethylene (PTFE). The rolling diaphragm 3 has a central portion that has a covered tubular shape. The rolling diaphragm 3 is disposed to cover the pressure gauge 6 with the central portion from the first axial side (the front side).

The rolling diaphragm 3 has a central portion 31, an outer peripheral portion 32, and a folded portion 33. The central portion 31, which constitutes a circular lid portion of the rolling diaphragm 3, is disposed to face the pump chamber 28 and a first axial end (a ceiling) of the housing 2, that is, the lid 18.

The outer peripheral portion 32, which constitutes a circular rim of the rolling diaphragm 3, is disposed at a larger radius than the central portion 31 and held between the cylinder 11 and the pump head 12. The folded portion 33 has flexibility and is deformable between the central portion 31 and the outer peripheral portion 32.

The rolling diaphragm 3 can be reciprocated integrally with the pressure gauge 6, while deforming the folded portion 33 between the inner wall of the housing 2 and the pressure gauge 6 to displace the central portion 31 in the axial direction of the housing 2 with the outer peripheral portion 32 fixed to the housing 2.

The rolling diaphragm 3 partitions the first interior space 14 of the housing 2 into the pump chamber 28 and a decompression chamber 38 liquid-tightly and airtightly. The pump chamber 28 is enclosed in the rolling diaphragm 3 (the central portion 31 and the folded portion 33) and the pump head 12.

Consequently, the pump chamber 28 can be changed (increased or decreased) in volume by displacement of the rolling diaphragm 3 accompanied by reciprocation of the rolling diaphragm 3 with the pressure gauge 6 and the shaft 22 in the axial direction of the housing 2, that is, by displacement of the central portion 31 accompanied by deformation of the folded portion 33.

During operation of the diaphragm pump 1, the pump chamber 28 is connected to both the suction port 15 and the discharge port 16. The pump chamber 28 can temporarily store fluid sucked through the suction port 15 until it is discharged to the outside. The decompression chamber 38 communicates with the vent hole 13 to be depressurized by the decompression device.

The first interior space 14 is partitioned by the rolling diaphragm 3 into the pump chamber 28 and the decompression chamber 38 in the present embodiment. This is not a limiting condition. The first interior space 14 may be partitioned into the pump chamber 28 and an atmosphere chamber communicating with the atmosphere through the vent hole 13.

The actuator 4 in the diaphragm pump 1 includes a motor 40 as a drive source. The actuator 4 includes the output shaft 42 in addition to the shaft 22 and the motor 40.

The motor 40 is a pulse motor (a stepping motor). The motor 40 is provided on the second axial side (the back side) of the housing 2. The output shaft 42 is a screw shaft (a lead screw). The output shaft 42 is connected to the rotating shaft of the motor 40 to be interlocked with it.

The motor 40 is not limited to a particular type. The motor 40 may be a type other than a pulse motor (a stepping motor).

The output shaft 42 is projected from the motor 40 into the housing 2 and reciprocable in the axial direction of the housing 2. The output shaft 42 is disposed coaxially with the shaft 22. A tip (a front end) of the output shaft 42 is connected to the second axial end (the back end) of the shaft 22 by the shaft holder 29.

The actuator 4 can convert rotational motion of the motor 40 into linear motion of the output shaft 42 and transmit the motion from the output shaft 42 to the shaft 22 to reciprocate the rolling diaphragm 3 in the axial direction of the housing 2.

The actuator 4 uses an encoder 45 (see FIG. 3). The encoder 45 is attached to the rotating shaft of the motor 40. The encoder 45 is used for the drive control of the motor 40. The encoder 45 is configured to output signal pulses synchronized with the rotation of the motor 40.

The pressure gauge 6 has a pressure receiving portion 46. The pressure gauge 6 is configured to detect the pressure of fluid in the pump chamber 28 via the pressure receiving portion 46. The pressure gauge 6 is coupled to the rolling diaphragm 3 such that the pressure gauge 6 can be reciprocated integrally with the rolling diaphragm 3 by the actuator.

The pressure gauge 6 is disposed in the housing 2, more specifically, at a side of the decompression chamber 38 in the first interior space 14. The pressure gauge 6 is attached to the rolling diaphragm 3 from the opposite side of the pump chamber 28 (backside), that is, the pressure gauge 6 is fitted into a recess 39 formed by the central portion 31 and the folded portion 33.

In other words, the pressure gauge 6 is covered by the rolling diaphragm 3 from the pump chamber 28 (i.e. from a front side). In this state, the pressure gauge 6 is attached to the rolling diaphragm 3 to be coupled to the shaft 22 at the opposite side of the pump chamber 28 of the pressure gauge 6. Wiring 48 of the pressure gauge 6 leads to the outside.

Although the pressure gauge 6 is coupled to the rolling diaphragm 3 and the shaft 22, this does not mean that the pressure gauge 6 has to be fixed to them. That is, the pressure gauge 6 does not need to be fixed to the rolling diaphragm 3 and the shaft 22 when the decompression chamber 38 or the atmosphere chamber is provided in the first interior space 14 and the pressure in the decompression chamber or the atmosphere chamber is kept lower than the pressure in the pump chamber 28 (the pressure of fluid in the pump chamber 28).

The control device 8 is used for controlling the actuator 4 to move the rolling diaphragm 3 forward or backward. As shown in FIG. 3, the control device 8 is connected to the motor 40 and the encoder 45 via a controller (control board) 47; the control device 8 is connected to the pressure gauge 6 via the wiring 48.

Note that forward movement in the reciprocation of the rolling diaphragm 3 is movement in a forward direction (advancement, movement to decrease the volume of the pump chamber 28), and backward movement is movement in a backward direction (retreat, movement to increase the volume of the pump chamber 28).

The control device 8 is configured to output a drive signal to the controller 47 to control the drive of the motor 40. The controller 47 is configured to, based on the drive signal, output signal pulses to the motor 40 to drive the motor 40.

The controller 47 acquires the signal pulses from the encoder 45. Based on the signal pulses (esp. those number), the controller 47 detects a rotation amount (i.e. an angle of rotation) or the like of the motor 40. The controller 47 outputs the detected rotation amount or the like to the control device 8.

Based on the rotation amount or the like from the controller 47, the control device 8 determines a position of the rolling diaphragm 3 in the reciprocating direction. The control device 8 can also acquire a result of detection of the pressure gauge 6 to determine the pressure of fluid in the pump chamber 28.

The control device 8 performs the drive control of the motor 40 to reciprocate the rolling diaphragm 3 in the axial direction of the housing 2 and cause the diaphragm pump 1, during its operation, to perform suction and discharge processes alternately for fluid transfer.

When the diaphragm pump 1 performs a suction process, the control device 8 causes the motor 40 to rotate in a negative direction to move the rolling diaphragm 3 backward, i.e. in a direction to increase the volume of the pump chamber 28 (from the position shown in FIG. 1 to the position shown in FIG. 2). At that time, the control device 8 controls the suction-side valve to be opened and the discharge-side valve to be closed. Consequently, fluid is sucked into the pump chamber 28 through the suction port 15.

When the diaphragm pump 1 performs a discharge process, the control device 8 causes the motor 40 to rotate in a positive direction to move the rolling diaphragm 3 forward, i.e. in a direction to decrease the volume of the pump chamber 28 (from the position shown in FIG. 2 to the position shown in FIG. 1). At that time, the control device 8 controls the suction-side valve to be closed and the discharge-side valve to be opened. Consequently, fluid is discharged from the pump chamber 28 through the discharge port 16.

Figure 4:
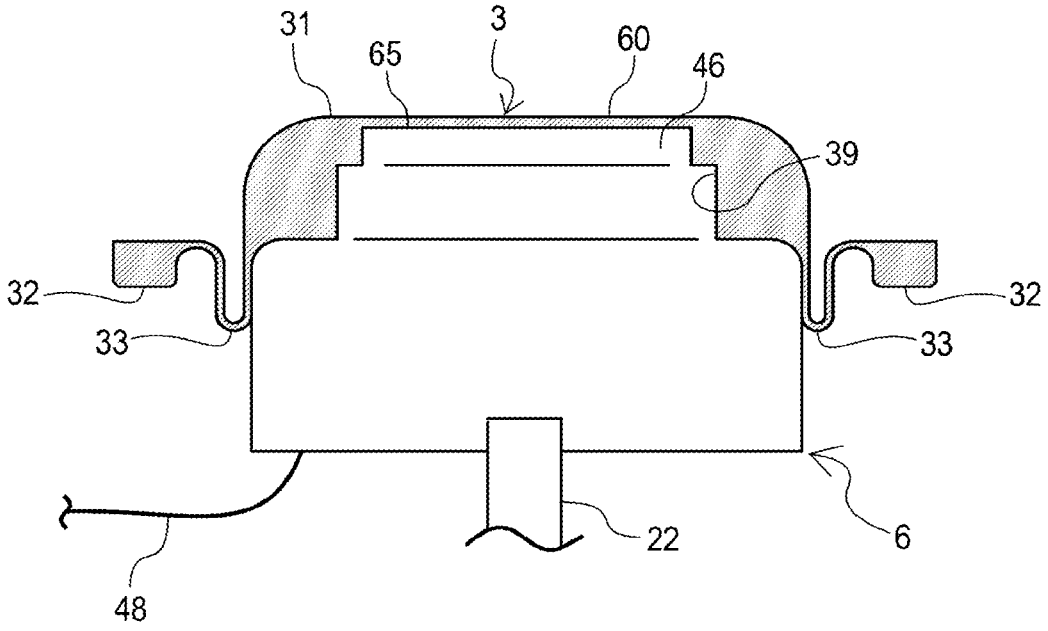
FIG. 4 is a side sectional view of the mounting structure of a pressure gauge in the reciprocating pump in FIG. 1.

As shown in FIGS. 1, 2, and 4, the rolling diaphragm 3 has a membranous portion 60. The membranous portion 60 has flexibility and is disposed between the pump chamber 28 and the pressure receiving portion 46 of the pressure gauge 6. The pressure gauge 6 is placed between the membranous portion 60 and the actuator 40 under the condition that the pressure receiving portion 46 contacts the membranous portion 60.

The membranous portion 60 is included in the central portion 31 of the rolling diaphragm 3. The membranous portion 60 radially extends on a plane substantially perpendicular to the reciprocating direction of the rolling diaphragm 3 from the center of the central portion 31 to the outside. The membranous portion 60 is substantially parallel to an abutting surface (front end) 65 of the pressure receiving portion 46 of the pressure gauge 6.

The membranous portion 60 faces the pump chamber 28, and in addition, the membranous portion 60 is disposed along the abutting surface 65 of the pressure receiving portion 46. The membranous portion 60 has a shape so flexible that it does not interfere with the function of the pressure receiving portion 46 of the pressure gauge 6 to detect the pressure of fluid in the pump chamber 28.

The membranous portion 60 is made of resin, for example, the same kind of resin as the rolling diaphragm 3. The membranous portion 60 has a thickness (the width in the reciprocating direction of the rolling diaphragm 3) within the range from about 0.1 mm to about 1 mm, preferably from about 0.1 mm to about 0.5 mm.

The pressure gauge 6 has a multistage cylindrical shape, which has circular cylinders with different diameters that are concentrically stacked one on top of the other in descending order of diameter. The pressure gauge 6 is coaxial with the housing 2. The pressure gauge 6 is disposed at the opposite (i.e. back) side of the membranous portion 60 from the pump chamber 28 in the axial direction of the housing 2. The pressure gauge 6 is attached to the rolling diaphragm 3 so that the pressure gauge 6 can reciprocate integrally with the membranous portion 60.

The pressure gauge 6 is closely fitted in a multistage recess 39 in the rolling diaphragm 3 such that its abutting surface 65 contacts the opposite (back) side of the membranous portion 60 of the rolling diaphragm 3 from the pump chamber 28, thus being positioned relative to the membranous portion 60 (or the rolling diaphragm 3). The abutting surface 65 of the pressure receiving portion 46 is substantially flat.

In this way, the pressure gauge 6 is held in a state where the pressure receiving portion 46 (or the abutting surface 65) contacts the membranous portion 60 and its side facing the pump chamber 28 (front side) is covered with the rolling diaphragm 3. At least a part of the pressure gauge 6, which includes the pressure receiving portion 46, is enclosed in the rolling diaphragm 3 such that the pressure gauge 6 is isolated from the pump chamber 28.

The above-described configuration prevents space, which causes a liquid pool when fluid fills the pump chamber 28, from forming in the pump chamber 28 due to structure allowing the pressure gauge 6 to be mounted thereon. Thus, no liquid pool can form in the pump chamber 28. Therefore, the diaphragm pump 1 can be used to transfer fluid, while maintaining the fluid at excellent purity.

Figure 5:
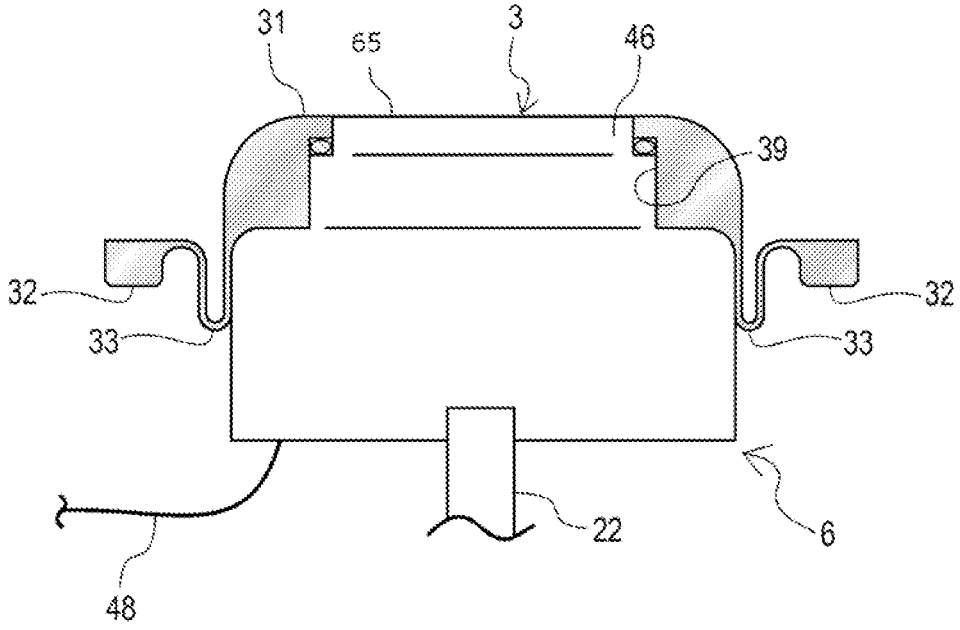
FIG. 5 is a side sectional view of a mounting structure of a pressure gauge according to another embodiment of the present invention.

The present embodiment uses the configuration with the membranous portion 60 intervening between the pressure receiving portion 46 and the pump chamber 28 for the mounting structure of the pressure gauge 6. Alternatively, as shown in FIG. 5, a configuration may be used, in which the central portion 31 of the rolling diaphragm 3 has an opening 65, and through the opening 65, the pressure receiving portion 46 is exposed to contact with fluid in the pump chamber 28.

The present embodiment relates to the positioning structure of the pressure gauge 6 with respect to the rolling diaphragm 3. The present embodiment uses the configuration in which the pressure gauge 6 with the multistage cylindrical shape is closely fitted in the multistage recess 39 of the rolling diaphragm 3. Alternatively, another configuration may be used.

A second embodiment of the present invention will be described with reference to the drawings.

Figure 6:
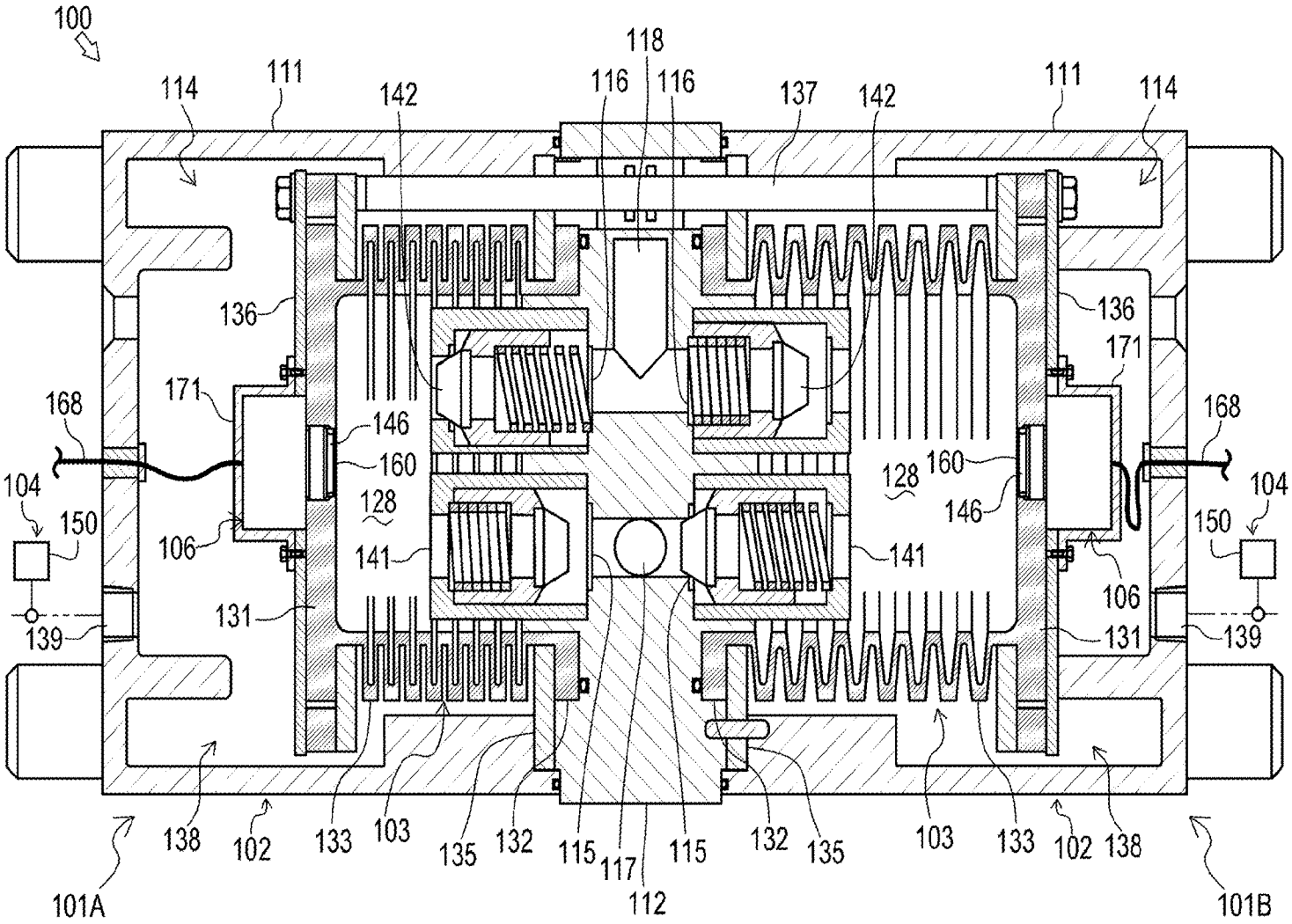
FIG. 6 is a side sectional view of a bellows pump, which is a reciprocating pump according to a second embodiment of the present invention.

A reciprocating pump according to the second embodiment of the present invention is a bellows pump 100 for transferring fluid including liquids such as chemical solutions. As shown in FIG. 6, the bellows pump 100 is a double-acting bellows pump including a first pump 101A and a second pump 101B.

The first pump 101A and the second pump 101B, which have substantially the same configuration, are arranged symmetrically with respect to a center line in the longitudinal direction of the bellows pump 100; the pumps 101A and 101B are configured to be operated complementarily during operation of the bellows pump 100.

In the bellows pump 100, the first pump 101A and the second pump 101B each include a housing 102, a reciprocated member (bellows) 103, an actuator 104, and pressure gauges 106. The bellows pump 100 further includes a control device (not shown).

The housing 102 has a suction port 115 and a discharge port 116. The housing 102 includes a pump casing 111 and a pump head 112. The pump head 112 is shared between the first pump 101A and the second pump 101B.

The pump casing 111 is made of resin, metal, or other materials, or composites of them. Preferably, the material of the pump casing 111 has resistance to surface corrosion. For example, the pump casing 111 is made of aluminum coated with fluororesin such as PTFE. The pump casing 111 has a bottomed, circular cylindrical shape and is disposed to be open to the pump head 112.

The pump head 112 is made of resin, metal, or other materials, or composites of them. Preferably, the pump head 112 has corrosion resistance. For example, the pump head 112 is made of fluororesin such as PTFE. The pump head 112 has a disk shape corresponding to the shape of the pump casing 111. The pump head 112 is arranged coaxially with the pump casing 111.

The pump head 112 is airtightly attached to the pump casing 111 to close the opening of the pump casing 111. Thus, interior space 114 is formed, which is enclosed in the pump casing 111 and the pump head 112 in the housing 102.

The pump head 112 has the suction port 115, the discharge port 116, a suction-side fluid channel 117, and a discharge-side fluid channel 118. The suction-side fluid channel 117 is provided in the pump head 112 to communicate with the suction port 115 and is connected to a device (not shown) predetermined as a fluid destination via a suction-side valve, piping, and others.

The discharge-side fluid channel 118 is provided in the pump head 112 to communicate with the discharge port 116 and is connected to a device (not shown) predetermined as a fluid destination via a discharge-side valve, piping, and others. The suction-side fluid channel 117 and the discharge-side fluid channel 118 are formed to change their respective directions in the middle.

The bellows 103 is disposed to form the pump chamber 128 in the housing 102 and is reciprocable in the housing 102 (extendable and contractible) to suck fluid into the pump chamber 128 through the suction port 115 and discharge the fluid from the pump chamber 128 through the discharge port 116.

The bellows 103 is made of resin, for example, fluororesin such as PTFE. The bellows 103 has a bottomed, circular cylindrical shape. The bellows 103 is attached to the pump head 112 with which the opening of the bellows 103 is closed. The bellows is extendable and contractible in the axial direction of the pump casing 111.

The bellows 103 has a closed end portion 131, an open end portion 132, and a pleated portion 133. The closed end portion 131 is provided at the bottom of the bellows 103. The open end portion 132 is provided at the opening of the bellows 103. The pleated portion 133 has a tubular shape and connects the closed end portion 131 with the open end portion 132.

The closed end portion 131 and the pleated portion 133 are located in the pump casing 111. They are disposed coaxially with the pump casing 111 and the pump head 112, together with the open end portion 132. The open end portion 132 is engaged with the pump head 112 by an annular engaging member 135 to fix the bellows 103 to the pump head 112.

The closed end portion 131 is connected to a movable body 136, which is disposed opposite to the pleated portion 133. The movable body 136 of one pump 101A is connected to a movable body 136 of the other pump 101B via a connecting rod 137. The connecting rod 137 can be reciprocated through the pump head 112 in the extension and contraction direction of the bellows 103.

The bellows 103 protrudes from the pump head 112 in the axial direction of the housing 102 and can extend from the pump head 112 or contract to it in the axial direction of the housing 102 to reciprocate the connecting rod 137. The open end portion 132, which constitutes a protrusion end portion of the bellows 103, is fixed to the pump head 112.

The bellows 103 liquid-tightly and airtightly partitions the interior space 114 of the housing 102 into the pump chamber 128 and an air chamber 138. The pump chamber 128 is enclosed in the bellows 103 (i.e. the closed end portion 131 and the pleated portion 133) and the pump head 112.

Thus, the pump chamber 128 can be changed (increased or decreased) in volume by the reciprocation of the bellows 103 in the axial direction of the housing 102, specifically, by deformation of the pleated portion 133 due to its extension or contraction and the accompanying displacement of the closed end portion 131.

The pump chamber 128 is connected to the suction port 115 and the discharge port 116. During operation of the bellows pump 100, the pump chamber 128 can temporarily store fluid sucked through the suction port 115 until it is discharged to the outside. The air chamber 138 is connected to an air inlet and outlet hole 139 through which air can be supplied and discharged.

The suction port 115 is provided with a suction-side check valve 141. The suction-side check valve 141 is attached to the pump head 112 to be located between the suction-side fluid channel 117 (i.e. the suction port 115) and the pump chamber 128. The suction-side check valve 141 allows fluid flowing only in one direction from the suction-side fluid channel 117 to the pump chamber 128.

The discharge port 116 is provided with a discharge-side check valve 142. The discharge-side check valve 142 is attached to the pump head 112 to be located between the discharge-side fluid channel 118 (i.e. the discharge port 116) and the pump chamber 128. The discharge-side check valve 142 allows fluid flowing only in one direction from the pump chamber 128 to the discharge-side fluid channel 118.

The actuator 104 reciprocates (extends and contracts) the bellows 103. The actuator 104 supplies pressurized air from an air supply device 150 to the air chamber 138 and discharge air from the air chamber 138 to the outside through the air inlet and outlet hole 139 in the pump casing 111.

The pressure gauges 106 each have a pressure receiving portion 146, via which they detect the pressure of fluid in the pump chamber 128. The pressure gauges 106 are coupled to the bellows 103 to be reciprocated by the actuator 104 integrally with the bellows 103.

Figure 7:
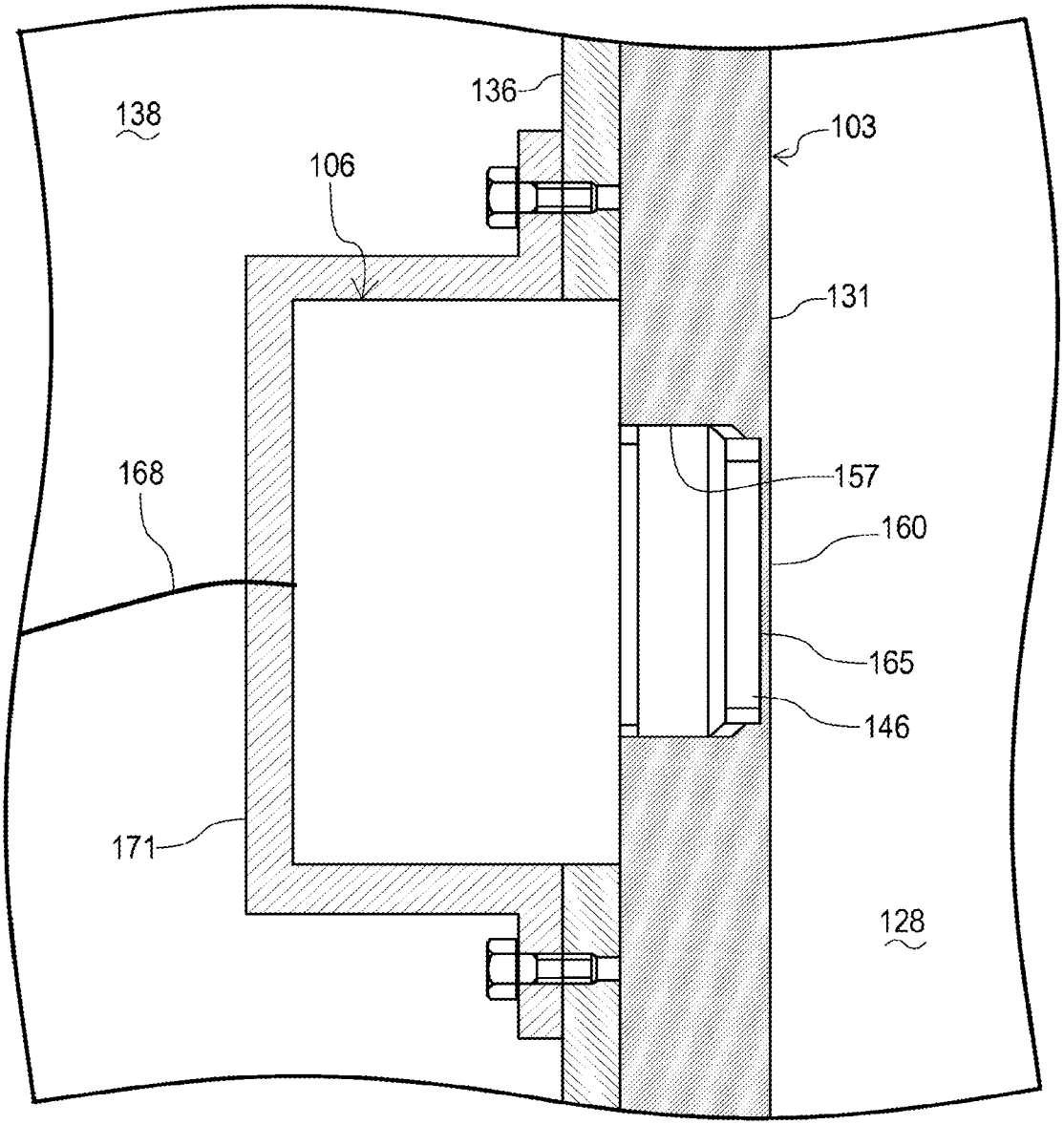
FIG. 7 is a side sectional view of the mounting structure of the pressure gauge in the reciprocating pump in FIG. 6.
Figure 8:
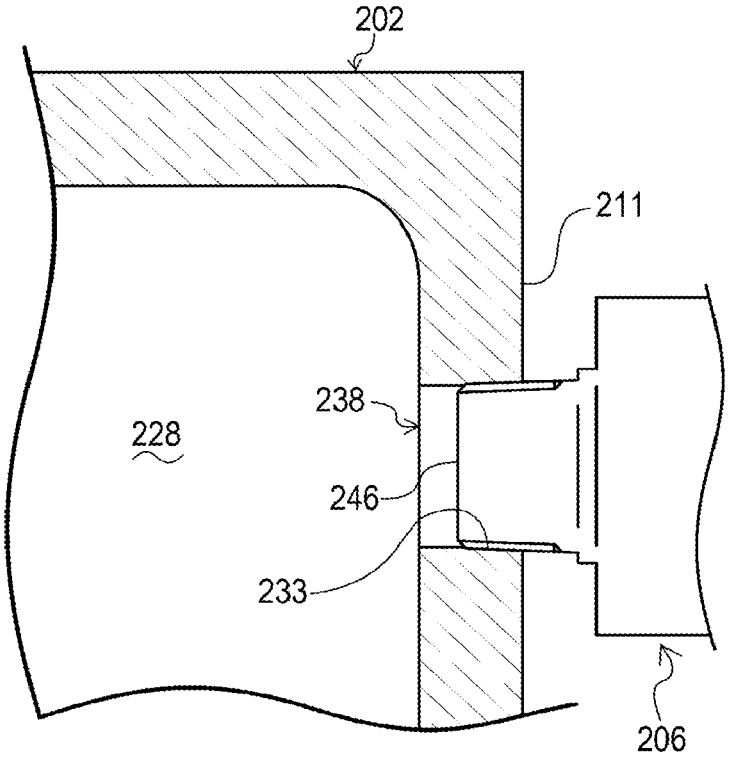
FIG. 8 is a cross-sectional view of the mounting structure of a pressure gauge in a conventional reciprocating pump.

As shown in FIG. 7, the pressure gauge 106 is arranged in the housing 102, more specifically, at a side of the air chamber 138 in the interior space 114. The pressure gauge 106 is fitted in a mounting hole 157 in the closed end portion 131.

In other words, the pressure gauge 106 is covered with the bellows 103 from the pump 128 (i.e. from a front side). In this state, the pressure gauge 106 is attached to the bellows 103 and displaced integrally with the closed end portion 131 in the extending or contracting direction of the bellows 103. Wiring 168 of the pressure gauges 106 leads to the outside.

The control device is used for controlling the actuator 104 to contract or extend the bellows 103. The control device is connected to the air supply device 150 of the actuator 104. The control device is connected to the pressure gauges 106 via the wiring 168.

When the bellows pump 100 operates, the control device can perform drive control of the actuator 104 to extend and contract the bellows 103 in the axial direction of the housing 102 such that the first pump 101A and the second pump 101B perform alternately suction and discharge processes for fluid transfer.

For example, when the first pump 101A performs a suction process, the control device operates the actuator 104 to supply compressed air to the air chamber 138 in the second pump 101B and discharge air from the air chamber 138 in the first pump 101A to the outside, thereby causing the second pump 101B to perform a discharge process.

Consequently, the first pump 101A sucks fluid from the suction-side fluid channel 117 into the pump chamber 128 through the suction port 115. Simultaneously, the second pump 101B discharges fluid from the pump chamber 128 into the discharge-side fluid channel 118 through the discharge port 116.

When the first pump 101A performs a discharge process, the control device operates the actuator 104 to supply compressed air to the air chamber 138 in the first pump 101A and discharge air from the air chamber 138 in the second pump 101B to the outside, thereby causing the second pump 101B to perform a suction process.

Consequently, the first pump 101A discharges fluid from the pump chamber 128 into the discharge-side fluid channel 118 through the discharge port 116. Simultaneously, the second pump 101B sucks fluid from the suction-side fluid channel 117 into the pump chamber 128 through the suction port 115.

As shown in FIGS. 6 and 7, the bellows 103 includes the membranous portion 160. The membranous portion 160 is disposed between the pump chamber 128 and the pressure receiving portion 146 of the pressure gauge 106. The pressure gauge 106 is disposed between the membranous portion 160 and the actuator 104 to make the pressure receiving portion 146 contact the membranous portion 160.

More specifically, the membranous portion 160 is included in the closed end portion 131 of the bellows 103. The membranous portion 160 radially extends on a plane substantially perpendicular to the reciprocating direction of the bellows 103 from the center of the bellows 103 to the outside. The membranous portion 160 is substantially parallel to the abutting surface 165 of the pressure receiving portion 146 in the pressure gauge 106 that contacts the membranous portion 160.

The membranous portion 160 faces the pump chamber 128 and in addition, it is disposed along the abutting surface 165 of the pressure receiving portion 146. The membranous portion 160 has a shape so flexible that it does not interfere with the function of the pressure receiving portion 146 of the pressure gauge 106 to detect the pressure of fluid in the pump chamber 128.

The membranous portion 160 is made of resin, for example, the same kind of resin as the bellows 103. The membranous portion 160 has a thickness (the width of the reciprocating direction of the bellows 103) within the range from about 0.1 mm to about 1 mm, preferably from about 0.1 mm to about 0.5 mm.

The pressure gauge 106 has a multistage cylindrical shape, which has circular cylinders with different diameters that are concentrically stacked one on top of the other in descending order of diameter. The pressure gauge 106 is coaxial with the housing 102. The pressure gauge 106 is disposed at the opposite side of the membranous portion 160 from the pump chamber 128 in the axial direction of the housing 102. The pressure gauge 106 is attached to the bellows 103 to be reciprocated (displaced) integrally with the membranous portion 160.

The pressure gauge 106 is fitted in the mounting hole 157 in the bellows 103 such that its abutting surface 165 contacts the opposite side of the membranous portion 160 of the bellows 103 from the pump chamber 128. In addition, the pressure gauge 106 is held by the holding member 171 to be positioned with respect to the membranous portion 160 (i.e. the bellows 103). The abutting surface 165 of the pressure receiving portion 146 is substantially flat.

In this way, the pressure gauge 106 is held in a state where the pressure receiving portion 146 (esp. the abutting surface 165) contacts the membranous portion 160, and its side facing the pump chamber 128 is covered with the bellows 103. At least a part of the pressure gauge 146, which includes the pressure receiving portion 146, is enclosed in the bellows 103 such that the pressure gauge 106 is isolated from the pump chamber 128.

The above-described configuration prevents space, which causes a liquid pool when fluid fills the pump chamber 128, from forming in the pump chamber 128 due to structure allowing the pressure gauges 106 to be mounted thereon. This can prevent the liquid pool from forming in the pump chamber 128. Therefore, the bellows pump 100 can be used to transfer fluid while maintaining the fluid at excellent purity.

In view of the above-described teaching, it is obvious that the present invention can have many variations and modifications. It is therefore to be understood that the present invention can have an embodiment other than those described above within the scope of the attached claims.

For example, the pressure gauge 6 of the first embodiment may be connected to the controller 47 via the wiring 48 so that the controller 47 acquires a result of detection from the pressure gauge 6. The controller 47 may be incorporated in the control device 8. In that case, the motor 40 and the encoder 45 are directly connected to the control device 8, and the control device 8 outputs signal pulses for driving the motor 40 to the motor 40, and it acquires signal pulses output from the encoder 45.

DESCRIPTION OF REFERENCE NUMERALS

1: diaphragm pump (reciprocating pump); 2: housing; 3: rolling diaphragm (reciprocated member); 4: actuator; 6: pressure gauge; 28: pump chamber; 46: pressure receiving portion; 60: membranous portion; 100: bellows pump (reciprocating pump); 102: housing; 103: bellows (reciprocated member); 104: actuator; 106: pressure gauge; 128: pump chamber: 146: pressure receiving portion; 160: membranous portion

What is claimed is:

1. A reciprocating pump for transferring fluid, comprising:

a housing with a suction port and a discharge port;

a reciprocated member disposed in the housing to form a pump chamber, and reciprocable such that fluid is sucked into the pump chamber through the suction port and discharged from the pump chamber through the discharge port, the reciprocated member including a moving wall defining the pump chamber within the housing, an opposite side of the moving wall from the pump chamber includes a recess, a bottom of the recess defined by a flexible membranous portion having a thickness smaller than a surrounding portion of the reciprocated member;

an actuator configured to reciprocate the reciprocated member; and a pressure gauge with a pressure receiving portion, configured to detect pressure of fluid in the pump chamber through the pressure receiving portion, and coupled to the reciprocated member to be reciprocated by the actuator integrally with the reciprocated member, and fitted into the recess of the moving wall with the pressure receiving portion abutting on the flexible membranous portion of the recess so that the pressure gauge is covered by the moving wall from the pump chamber.

2. The reciprocating pump according to claim 1, wherein the moving wall reciprocated member comprises a rolling diaphragm.

3. The reciprocating pump according to claim 1, wherein the moving wall reciprocated member comprises a bellows.

* * * * *